United States Patent [19]

Friedrich et al.

[11] Patent Number: 4,755,401

[45] Date of Patent: Jul. 5, 1988

[54] ARTIFICIAL TURF WITH PLAYING FIELD MARKINGS

[75] Inventors: Hans-Joachim Friedrich, Auenwald; Otfried von Kries, Dietenheim, both of Fed. Rep. of Germany

[73] Assignee: J. F. Adolff AG, Backnang, Fed. Rep. of Germany

[21] Appl. No.: 9,755

[22] Filed: Feb. 2, 1987

[30] Foreign Application Priority Data

Feb. 5, 1986 [DE] Fed. Rep. of Germany ..... 3603386

[51] Int. Cl.[4] ..... A41G 1/00

[52] U.S. Cl. ..... 428/17; 273/DIG. 13; 273/DIG. 30; 428/88; 428/100

[58] Field of Search ..... 428/17, 100, 88; 273/30, DIG. 13, DIG. 30

[56] References Cited

U.S. PATENT DOCUMENTS

| | | | |
|---|---|---|---|
| 2,771,383 | 11/1956 | Fine | 428/78 |
| 4,152,473 | 5/1979 | Layman | 428/17 |
| 4,489,115 | 12/1984 | Layman et al. | 428/17 X |
| 4,581,269 | 4/1986 | Tilman | 428/100 X |
| 4,588,628 | 5/1986 | Roth | 428/85 |

*Primary Examiner*—Henry F. Epstein

*Attorney, Agent, or Firm*—Kramer, Brufsky & Cifelli

[57] ABSTRACT

The invention relates to a ground covering in the form of an artificial turf material with lasting playing field marking lines. In accordance with the invention, the marking lines are formed by separately manufactured material strips and attached to the adjacent turf material using the elements of a hook and loop fastener.

10 Claims, 1 Drawing Sheet

ARTIFICIAL TURF WITH PLAYING FIELD MARKINGS

The invention relates to a ground covering in the form of an artificial turf material with lasting playing field marking lines, at least one of which is formed by a separately manufactured material strip which is joined to the adjacent turf material by a joining strip overlapping the interface or gap between the material strip and the adjacent turf material.

It is known to equip indoor and outdoor sports and games facilities with a ground covering in the form of an artificial turf material which, depending on the given circumstances, is permeable or impermeable to water. Turf materials lined with a filter layer on the rear side or underside which serves, on the one hand, to let surface water off into the subsoil and, on the other hand, to prevent subsoil material from rising up into the pile of the artificial turf, are also known.

Particularly if the artificial turf is to be laid on a playing field for a certain type of sport, for example, on a tennis court, a football field or the like, lasting playing field marking lines are required in the turf material. The easiest way of applying such marking lines is to color the pile of the turf with a liquid coloring material in the marking line areas. Whitewash, for example, is easiest to use. The marking lines may also be made by filling the pile in the area of these lines with a particulate material such as, for example, chalk, brick dust or sawdust. A disadvantage of these simple methods of producing marking lines on playing fields is that the colors wash out and/or wear off the pile filaments when the playing field is used. On the other hand, particulate material which has been applied to the pile shifts into laterally adjacent areas of the turf material, making the marking lines blurred and less and less distinct with continued use of the ground, with the result that new playing field markings are required in both cases after only a short time.

It is also known for strip-like marking lines to be initially tufted into the turf material so as to give the pile filaments in the area of the marking lines a color which is different from the pile filaments of the adjacent turf material. An important advantage of this solution is that the strip-like marking lines differ practically only in color from the adjacent material but correspond fully to the adjacent turf material with respect to their durability and their playing characteristics (elasticity, slide behavior, etc.), which, in most cases, is desirable. Playing field marking lines which are tufted into the turf material are disadvantageous in that use of a different colored pile material increases manufacturing costs, a "made-to-measure" turf material with the required material strips must be made for each individual sports or games arena, and only straight marking lines can be made at economically acceptable cost. Numerous games such as, for example, football, handball, hockey, etc., do, however, require curved, in particular, circular marking lines.

It is, furthermore, known to use separately manufactured material strips which are usually inserted into a gap of correspdnding width cut in the turf material after it has been laid, for the playing field marking lines. In this case, this material strip is attached to the turf material with the aid of a joining strip overlapping the interface or gap between the material strip and the turf material. The joining strip is coated with an adhesive and serves to bond the underside of the turf material with the underside of the material strip acting as playing field marking lines.

Use of such a joining strip in the form of an adhesive strip has proven problematic as correction of the material parts to be aligned with one another is rendered practically impossible by the adhesive once an adhesive connection has been established. Also, handling of the adhesive strip is bothersome on account of the adhesive spontaneously adhering to everything with which it comes into contact, with the result that the hands and appliances of the workmen laying the ground covering are soiled after only a short time by adhesive residues which, to say the least, severely impede precise workmanship.

Departing from the prior art, the object of the invention is to so improve a ground covering of the kind described at the outset that lasting, straight and curved playing field marking lines can be clearly and precisely produced at acceptable financial cost.

This object is attained in accordance with the invention in a ground covering of the generic kind by the material strip being firmly joined on its underside to a first element of a hook and loop fastener consisting of a loop tape and a hook tape, by the turf material adjacent to the material strip being firmly joined on its underside, at least along the material strip, to a further first element of such a hook and loop fastener, and by the first elements being joined to one another by a joining strip forming the second element of the hook and loop fastener.

A special advantage of the ground covering according to the invention is that use of a hook and loop fastener eliminates open adhesive surfaces which prevent clean handling and precise alignment of the materials when the turf material and the separately manufactured material strip are finally mutually fixed. A further advantage of the ground covering according to the invention is that after a first fixing, the elements of the hook and loop fastener can be undone once again to correct the mutual alignment of turf material and material strip, if necessary. A further important advantage is gained with a ground covering according to the invention if a certain ground surface is to be laid out only temporarily with a ground covering, as is the case, for example, in multipurpose halls. In such an instance, the hook and loop fastener can be opened along a marking line, for example, along the halfway line of the playing field to divide the ground covering up into two or several areas which can be rolled up into easy to handle rolls and stored for later reuse.

It has proven advantageous for the joining strip to be of such width that it overlaps the interfaces on either side side of the material strip inserted into the turf material. It can, however, also be of advantage to use two separate joining strips which each overlap only one interface.

In a further development of the invention, it has also proven expedient for the rear side of the turf material adjacent to the interface(s) to be partly removed as far as to create a recess for the elements of the hook and loop fastener, with its height corresponding approximately to the height of the elements of the hook and loop fastener. The height of the material strip to be inserted into the turf material is, of course, similarly chosen so as to obtain a smooth continuous surface in the playing field marking line areas, thereby, for example, preventing a ball from bouncing erratically.

In a ground covering according to the invention, the same material is normally used for the material strips which are to form the playing field marking lines as for the adjacent artificial turf, but with differently colored pile filaments. The inserted marking strips may, however, also be made from a different material, for example, a suitable felt or a plastic material so that it is possible to determine from the impact sounds whether a ball has hit the turf material or the area of a marking line.

To comply with the respective requirements, the characteristics of the loop tape, on the one hand, and the hook tape, on the other hand, may, furthermore, be adapted to one another so as to produce either a practically firm joint or a joint which, if required, is easily undone.

BRIEF DESCRIPTION OF THE DRAWINGS

Further details and advantages of the invention are explained more fully hereinafter with reference to drawings, in which:

FIG. 1 shows in detail a ground covering consisting of an artificial turf material 10 into which a separately manufactured material strip 12 is inserted as lasting playing field marking line. This material strip 12 preferably differs from the turf material 10 adjoining it on the right and left only in that its pile filaments are a different color from the pile filaments of the adjacent turf material 10. The pile filaments of the turf material 10 are generally green, whereas the pile filaments of the material strip 12 are brightly colored, for example, white or yellow, and may consist of uncolored polymer material. The turf material 10 and the material of the material strip 12 may each consist of pile filaments tufted into a fabric back comprising on its rear side, i.e., on the side remote from the pile, a more or less thick back coating, for example, a rubber-like coating, permeable or impermeable to water, which imparts the desired elasticity and damping effect to the ground covering. In accordance with the invention, a loop tape 14 constituting a first element of a hook and loop fastener consisting of a loop tape and a hook tape is joined to the rear side or underside of the material strip 12. Loop layers or tapes 14 are provided on the underside of the turf material, more particularly, at least throughout a given width with respect to each edge of the turf material 10 adjacent to the material strip 12. The second element of the aforementioned hook and loop fastener is formed by a hook tape 16 serving as joining strip which overlaps the interfaces 18 between the turf material 10 and the material strip 12 on either side throughout a given width.

Figure 1:
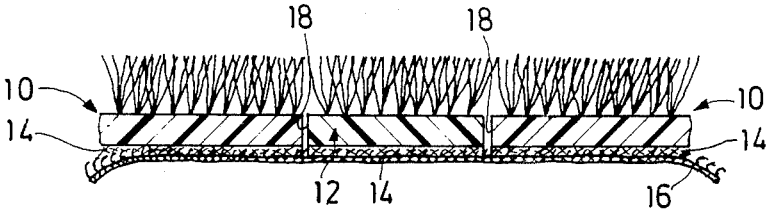
FIGS. 1 to 3 show schematic cross-sectional views, not true to scale, taken through ground coverings according to the invention in the area of a playing field marking line.

The ground material shown in FIG. 1 can be manufactured in the following way: The turf material 10 is first laid over a large surface, where appropriate, in interconnected webs, and a strip whose width corresponds to the desired width of the playing field marking line to be made is then cut out of the laid turf material with the aid of a cutting device comprising two rotating blades or the like. The edges of the turf material are also bent upwardly at the cut edges and are provided with loop tapes on the underside. This is preferably done at the same time as the strip is cut out of the turf material, for which purpose, the cutting device may be provided with supply rolls of strips of the loop tape which are coated with an adhesive and are bonded to the underside of the turf material adjacent to the cut edges. Upon completion of this preparation work for the turf material, the hook tape 16 whose width is selected so as to protrude on either side, in compliance with the respective requirements, beyond the cut edges of the turf material, is laid underneath the underside of the turf material 10 and below the loop tapes 14. A separately manufactured material strip 12 with a loop tape 14 provided in advance on its underside is subsequently inserted into the slit previously cut out of the turf material. The color of the pile of the material strip differs from that of the pile of the turf material. Once it has been ascertained that the inserted material strip fits exactly into the cut-out gap in the turf material, suitable pressure is exerted above the hook tape 16 onto the turf material and onto the material strip to ensure reliable engagement of the elements of the hook and loop fastener. If, on the other hand, after insertion of the separately manufactured material strip, the ground covering does not form a smooth continuous surface, it is still possible to undo the strip and/or the edges of the turf material from the hook tape 16 again, in order to obtain the desired precise mutual alignment of the elements of the ground covering and to then secure these in the new position by exerting pressure thereon.

The above-described laying procedure is facilitated if there is initially permanently attached to the underside of the turf material a filter mat whose areas adjacent to the edges of the cut-out slit act, in this case, as loop tapes of the hook and loop fastener, thereby eliminating the need for separate adhesion of the loop tapes. If a turf material with a filter layer is used, the separately manufactured material strip is preferably also cut out of such material, which dispenses with the necessity for separate attachment of a loop tape, in this case, too.

In the above description of the embodiment shown in FIG. 1, it was assumed that the material thickness of loop tape and hook tape in the closed hook and loop fastener state, in relation to the height of the pile and to the thickness of the back of the turf material, is so slight that there are practically no changes of any consequence in the playing characteristics of the ground in the area of the inserted playing field marking lines when the ground covering has been completely laid. The elements of the hook and loop fastener may, however, also be inserted into recesses provided on the rear side of the turf material to obtain a completely level ground covering, as will be explained in greater detail hereinafter with reference to FIG. 3.

In the foregoing, it was, furthermore, assumed that loop tapes are joined to the underside of the turf material and the separately manufactured material strip and that the hook tape is laid out separately. The arrangement can, of course, also be of opposite configuration, with the joining strip consisting of loop material and single, correspondingly narrower hook tapes being attached to the rear side of the turf material and the material strip.

Figure 2:
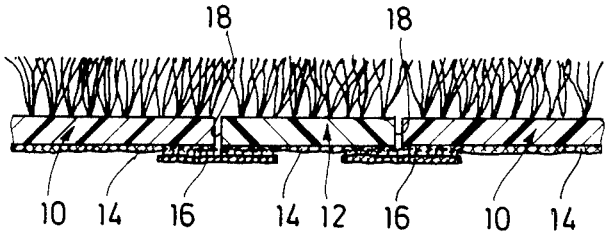

As is apparent from the embodiment of the invention shown in FIG. 2, it is also possible for each of the two interfaces on either side of the inserted material strip to be bridged by a separate, correspondingly narrower hook tape 16 (or with a corresponding loop strip). This embodiment is of advantage, particularly if the ground covering has to be laid out several times and removed again, as is the case, for example, in multipurpose halls, since the narrower hook tapes advantageously enable the ground covering to be divided up in the respective interface areas into sections which are easy to handle.

Figure 3:
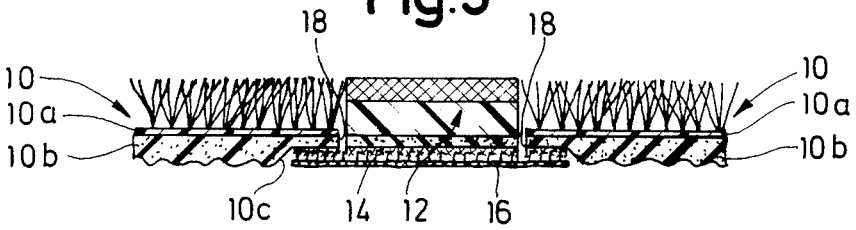

In the embodiment shown in FIG. 3, the fabric back and the back coating of the turf material 10 are separately illustrated. The fabric back is designated by reference numeral 10*a*, and the back coating by reference numeral 10*b*. As is apparent from the Figure, the material of the back coating 10*b* adjacent to the interfaces 18 has been removed by, for example, abrasion to form a recess 10*c* to make room for complete accommodation of the elements 14, 16 of the hook and loop fastener, thereby preventing formation of a bead-like elevation in the ground covering in the area of the inserted playing field marking lines. In addition, the upper side of the separately manufactured material strip 12 in the embodiment shown in FIG. 3 does not consist of a pile, but instead of various material layers which, on the one hand, ensure the desired playing characteristics of the ground covering, and, on the other hand, protrude with particularly clear contours from the pile of the adjacent turf material 10. The single layers of the separately manufactured material strip 12—this material strip may also comprise only one layer—can consist, for example, of felt, foamed plastic material or the like.

As is evident from the above description, it is possible, in accordance with the invention, to create at relatively low cost a ground covering with lasting playing field marking lines of any shape and curvature enduringly inserted therein, which is a precondition of importance to the players and referees for an orderly game.

It is also clear from the above description that the scope of the invention covers a method for manufacturing a ground covering according to the invention (see pages 6 and 7 of the Specification) and a cutting device for performing this method which includes means for bonding elements of the hook and loop fastener along the cut edges.

What is claimed is:

1. A ground covering with marking lines, comprising:

a first area of artificial turf material having a first edge;

a strip material being disposed adjacent to said first edge forming a first interface therebetween;

hook and loop fastening tape means attached to the underside of both said first area of artificial turf material and said strip material, said hook and loop fastening tape means overlapping the first interface between said strip material and said first area of turf material;

said hook and loop fastening tape means comprising first and second tape strips, wherein either said first or said second tape strip comprising a loop fastening strip and the other of said tape strips being a hook fastening strip;

said first tape strip comprising first and second strip elements being independently and firmly joined to the underside of both said first area of artificial turf material and said strip material; and said second tape strip being a third strip element overlapping the first and second strip elements to join the first and second strip elements together.

2. The ground covering of claim 1, further including a second area of artificial turf material having a second edge disposed a distance from said first edge corresponding to the width of said strip material, said second edge forming a second interface with said strip material;

said first tape strip comprising a fourth strip element independently and firmly joined to the underside of said second area of artificial turf material; and the third strip element overlapping the first, second and fourth strip elements to join the first, second and fourth strip elements together.

3. The ground covering of claim 2, wherein said strip material is selected from the group consisting essentially of artificial turf material, felt material and plastic material.

4. The ground covering of claim 3, wherein said first tape strips are loop tapes and said second tape strips are hook tapes.

5. The ground covering of claim 3, wherein said first tape strips are hook tapes and said second tape trips are loop tapes.

6. The ground covering of claim 1, further including a second area of artificial turf material having a second edge dispose a distance from said first edge corresponding to the width of said strip material, said second edge forming a second interface with said strip material;

said third strip element overlapping the first and second strip elements;

said first tape strip comprising a fourth strip element independently and firmly joined to the underside of said second area of artificial turf material;

said second tape strip including a fifth strip element overlapping the second and fourth strip elements whereby said first, second and fourth tape strip elements are firmly joined together.

7. The ground covering of claim 6 wherein said strip material is selected from the group consisting essentially of artificial turf material, felt material and plastic material.

8. The ground covering of claim 7, wherein said first tape strips are loop tapes and said second tape strips are hook tapes.

9. The ground covering of claim 7, wherein said first tape strips are hook tapes and said second tape strips are loop tapes.

10. The ground covering of claim 2 including first and second recessed sections in the underside of said first and second areas of artificial turf extending adjacent to said first and second edges respectively for receiving said first and second tape strips whereby said first and second tape strips do not protrude below the underside of the back surface of the first and second areas of artificial turf material whereby said first and second recess corresponds in height approximately to the height of the hook and loop fastener means.

* * * * *